United States Patent [19]

Weas

[11] 4,372,353

[45] Feb. 8, 1983

[54] ARRANGEMENTS FOR SENSING THE PRESENCE OF LIQUID IN A VAPOR LINE

[75] Inventor: Tom Weas, Cincinnati, Ohio

[73] Assignee: Dover Corporation, New York, N.Y.

[21] Appl. No.: 208,998

[22] Filed: Nov. 21, 1980

Related U.S. Application Data

[63] Continuation-in-part of Ser. No. 45,204, Jun. 4, 1979, abandoned.

[51] Int. Cl.[3] ..... B65B 3/18; B65B 57/14

[52] U.S. Cl. ..... 141/206; 137/199; 141/226; 141/302

[58] Field of Search ..... 137/197, 199, 493.3, 137/493.4, 493.6; 141/59, 198, 206–229, 301–303, 392

[56] References Cited

U.S. PATENT DOCUMENTS 4,062,384 12/1977 Frahm et al. ..... 141/302 X

*Primary Examiner*—Frederick R. Schmidt

*Attorney, Agent, or Firm*—Kinney and Schenk

[57] ABSTRACT

An automatic shut-off nozzle has liquid flow through its vapor return means automatically stopped when liquid has filled the vapor line sufficiently to move a first valve to block the vapor return line. This blocking of the vapor return line by the liquid increases the pressure in the tank being filled to cause stopping of liquid flow through the automatic shut-off nozzle. If the pressure in the tank increases beyond a predetermined pressure when the first valve is in its blocking position, the increased pressure is vented by a second valve, which is supported by the first valve, moving to an open position. The automatic shut-off nozzle also stops flow in response to the tank being filled to a predetermined level with liquid or to the pressure in the tank exceeding a predetermined pressure even when there is no blocking of the vapor line by the first valve. In another embodiment, a float valve activates a switch when liquid has filled the vapor line sufficiently to move the float valve with activation of the switch stopping flow of liquid to the nozzle.

25 Claims, 16 Drawing Figures

ARRANGEMENTS FOR SENSING THE PRESENCE OF LIQUID IN A VAPOR LINE

This application is a continuation-in-part of pending application Ser. No. 045,204, filed June 4, 1979, now abandoned.

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be returned to the tank from which the liquid is supplied.

However, the level of the gasoline within the vehicle tank being filled cannot be viewed because of the sealing of the fill pipe opening. Therefore, it is necessary for there to be automatic shut off of the supply of gasoline with a nozzle having a vapor recovery arrangement.

The automatic shut-off mechanism, which automatically stops the supply of gasoline to the vehicle tank, depends upon the level of the liquid in the tank reaching a predetermined level at which its blocks a vacuum passage opening in the nozzle spout to cause activation of release means to move the main poppet valve, which is controlling liquid flow from the inlet of the nozzle body through the nozzle body, to its closed position. However, because of the angles of the fill pipes of certain vehicles, the spout may be so disposed within the fill pipe that the vacuum passage opening in the nozzle spout cannot be blocked by the level of the gasoline in the vehicle tank prior to the gasoline flowing through vapor return means in the nozzle body.

Because of the vapor return seal sealing the fill pipe opening, the attendant cannot see the pitch of the nozzle spout within the fill pipe. Thus, the attendant cannot position the nozzle spout within the fill pipe so that the vacuum passage opening in the nozzle spout would be located so as to be blocked by the level of the gasoline in the tank prior to the gasoline in the tank escaping therefrom through the vapor return means of the nozzle body.

Accordingly, if the vacuum passage opening in the nozzle spout is not blocked by the level of the gasoline in the tank prior to the gasoline being able to flow through the vapor return means in the nozzle body, gasoline would be pumped through the fill pipe to the tank and then returned to the tank from which the liquid is supplied through the vapor return means in the nozzle body and a vapor line. As a result, the customer would pay for gasoline not received since the pumping of gasoline is utilized to determine the quantity supplied to the customer.

The present invention satisfactorily solves the foregoing problems through providing an arrangement in which the vapor line is blocked when a predetermined quantity of liquid is at a predetermined location in the vapor line. When this quantity of liquid is sensed at the predetermined location, the flow of liquid through the nozzle is automatically stopped. Thus, flow of liquid is stopped even when the vacuum passage opening in the nozzle spout cannot be blocked by the level of the liquid in the tank because of the angle of the fill pipe.

With the present invention, the automatic shut-off nozzle is still responsive to the blocking of the vacuum passage opening in the nozzle spout when the liquid in the tank reaches the predetermined level. Therefore, the present invention enables the automatic shut-off nozzle to continue to be effective when the spout opening is blocked by the level of the liquid in the tank.

With the present invention, the automatic shut-off nozzle also is still responsive to the pressure in the tank exceeding a predetermined pressure even when the vapor line is not blocked by the quantity of liquid in the vapor line. Accordingly, the automatic shut-off nozzle of the present invention is still responsive to the two conditions within the tank being filled.

An object of this invention is to sense or detect the presence of liquid in a vapor line.

Another object of this invention is to provide an arrangement for automatically stopping liquid flow to a tank or the like when liquid is detected or sensed in a vapor line communicating with the tank.

A further object of this invention is to provide an arrangement to prevent recirculation of liquid through a tank being filled from a supply source and a vapor line.

SUMMARY OF THE INVENTION

In accordance to the invention, an apparatus is provided for sensing the presence of liquid in a vapor line. The apparatus includes a body having an inlet and an outlet with a flow passage therebetween. The inlet is adapted to communicate with a source of liquid and vapor and the outlet is adapted to communicate with an area for receiving the vapor. A first valve means is disposed within the body for selectively blocking the flow passage. This first valve means is movable between a first position in which vapor flow past the valve is permitted and a second position in which vapor flow is blocked. The movement from the first to the second positions is made in response to the presence of liquid in the body. A second valve means has a seated position against the first valve means and is operative to permit selective fluid flow past the first valve means in response to a predetermined liquid pressure. This second valve means is biased to a first position and is movable to a second position in which fluid flow past the first valve means is permitted in response to the predetermined liquid pressure.

According to a further aspect of the invention, the body includes a base member and a tail member which are rotably connected to each other to form a swivel. In one preferred form of the invention, the tail member serves as a seat for the first valve means.

In yet another aspect of the invention, the first valve means is a float valve which includes means for generating an electrical signal in response to its position relative to the body.

A still further aspect of the invention includes an automatic shut-off nozzle with a body having an inlet and an outlet. Valve means are disposed in the body for controlling flow between the inlet and outlet. A spout communicates with the outlet and has a free end for disposition in an opening of a fill pipe of a tank or the like. The nozzle including means to return vapor from the tank being filled as well as a seal between the fill pipe opening and the vapor return means when the spout is disposed in the fill pipe. The vapor return means includes an apparatus for sensing the presence of fluid in a vapor line. The apparatus includes a vapor return body having a vapor return inlet and a vapor return outlet with a flow passage therebetween. The vapor return inlet is adapted to communicate with a source of liquid and vapor and the vapor return outlet is adapted to communicate with an area for receiving the vapor. A first valve means is disposed within the vapor return body for selectively blocking the flow passage. This first valve means is movable between a first position in which vapor flow past the valve is permitted and a second position in which vapor flow is blocked. The movement from the first to the second positions is made in response to the presence of liquid in the body. A second valve means has a seated position against the first valve means and is operative to permit selective fluid flow past the first valve means in response to a predetermined liquid pressure. This second valve means is biased to a first position and is movable to a second position in which fluid flow past the first valve means is permitted in response to the predetermined liquid pressure.

Other objects, uses, and advantages of this invention will become apparent upon a reading of the following detailed description and upon reference to the drawings, in which:

While the invention will be described in connection with preferred embodiments, it will be understood that it is not intended to limit the invention to those embodiments. On the contrary, it is intended to cover all alternatives, modifications, and equivalents as may be included within the spirit and scope of the appended claims.

DETAILED DESCRIPTION OF THE PREFERRED EMBODIMENTS

Figure 1:
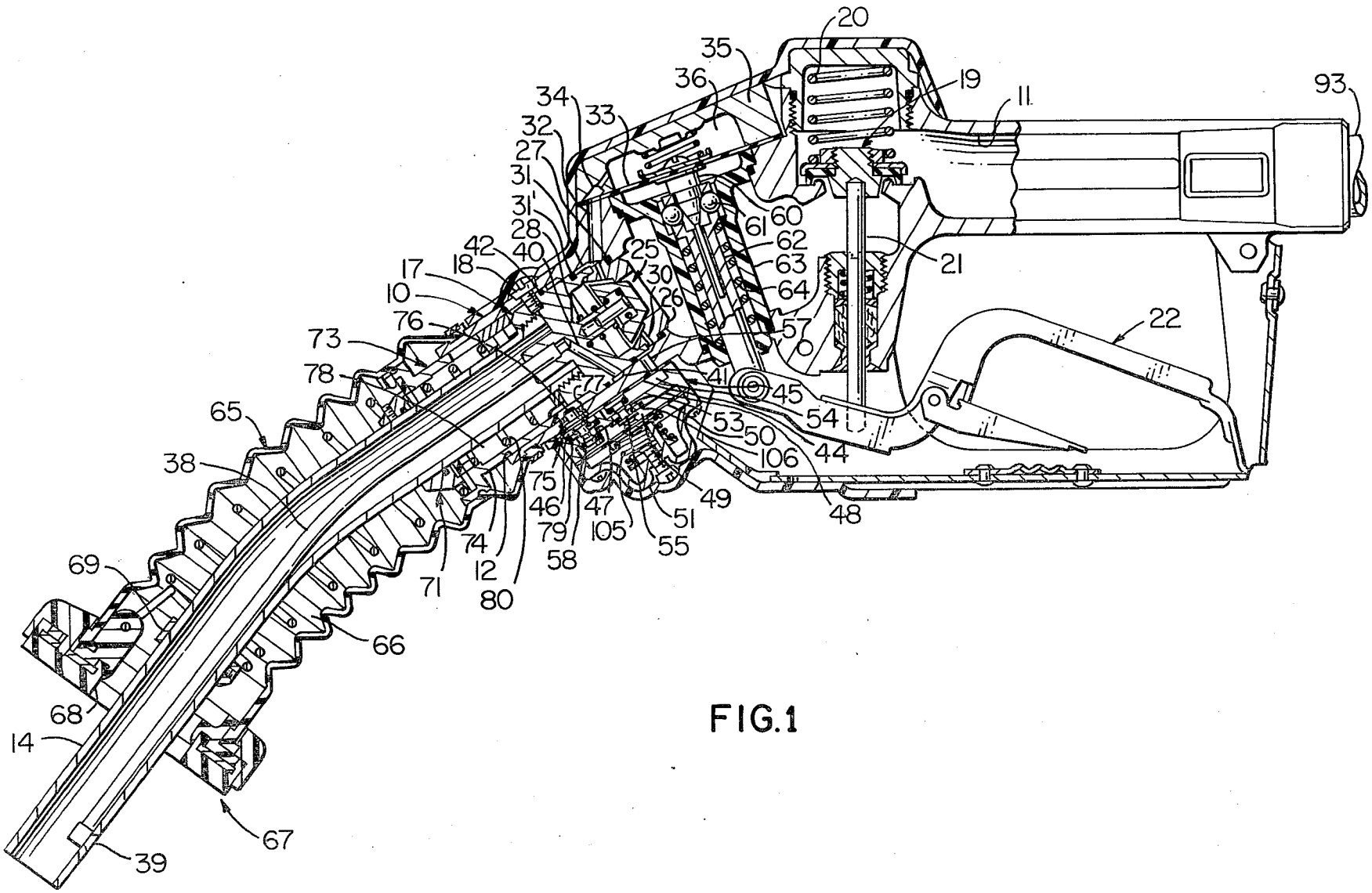
FIG. 1 is a sectional view, partly in elevation, of an automatic shut-off nozzle utilized with the sensing arrangement of the present invention.

Referring to the drawings and particularly FIG. 1, there is shown a nozzle body 10 having an inlet 11 to which a hose 11' (see FIG. 3) is connected to supply liquid such as gasoline, for example, to the interior of the body 10. The body 10 has an outlet 12 with which a spout 14 communicates to receive liquid from the interior of the body 10.

The spout 14, which is adapted to be inserted within an opening 15 (see FIG. 2) in a fill pipe 16 of a vehicle tank such as an automobile fuel tank, for example, has an end threaded in a spout adapter 17 (see FIG. 1). The spout adapter 17 is connected to the outlet 12 of the body 10 by a screw 18.

The body 10 has a first or main poppet valve 19 supported therein for control of the flow of liquid from the inlet 11 to the interior of the body 10 and from the interior of the body 10 to the outlet 12. A spring 20 continuously urges the first poppet valve 19 to its closed position in which flow from the inlet 11 to the outlet 12 is stopped or prevented.

A valve stem 21 is connected to the first poppet valve 19 and has its lower portion extending exteriorly of the body 10. The valve stem 21, which is slidably disposed within the body 10, is moved by a manually operated lever or handle 22. The valve stem 21 passes through the body 10 in the same manner as described in U.S. Pat. No. 3,811,486 to Wood.

A second poppet valve 25 is slidably mounted on the spout adapter 17 and is continuously urged into engagement with a seat ring 26, which is secured to the spout adapter 17 by a threaded connection, by a spring 28. A sealing ring 27 is disposed between the seat ring 26 and the body 10 to prevent liquid leakage therebetween. Thus, only the pressure of liquid going from the inlet 11 and past the first poppet valve 19 can overcome the spring 28 and move the second poppet valve 25 to an open position.

As the liquid flows between the second poppet valve 25 and the seat ring 26, a venturi effect is created in radially extending passages 30 in the seat ring 26. The outer ends of the passages 30 communicate with an annular chamber 31, which is formed between the body 10, the spout adapter 17, the seat ring 26, the sealing ring 27, and a sealing ring 31'. The passages 30 communicate through the chamber 31, a passage 32 in the body 10, an opening in a diaphragm 33, and a passage 34 in a cap 35 to a chamber 36, which is formed between the diaphragm 33 and the cap 35.

The chamber 31 also communicates with a vacuum tube 38, which is connected with an opening 39 in the spout 14 adjacent the discharge or free end of the spout 14. The vacuum tube 38 communicates through a passage 40 in the spout adapter 17 with a chamber 41, which is formed between the sealing ring 31', a sealing ring 42, the spout adapter 17, and the body 10.

The chamber 41 communicates through a passage (not shown) in the nozzle body 10 and an opening (not shown) in a seal 44, which is disposed between the body 10 and a housing 45 secured to the body 10, to a horseshoe-shaped passage 46 in the housing 45. This is more particularly shown in the copending patent application of Jack Alan McMath for "Automatic Shut-Off Nozzle With Vapor Return Seal," Ser. No. 323,372, filed Nov. 20, 1981, and assigned to the same assignee as the assignee of this application.

The horseshoe-shaped passage 46 in the housing 45 communicates through a passage 47 in a divider 48 of the housing 45 with a chamber 49, which is formed between the divider 48 and a diaphragm 50. A retainer 51 holds the diaphragm 50 on the housing 45.

The chamber 49 communicates through a passage 53 in the divider 48 of the housing 45 with a chamber 54, which is formed within the housing 45 between the divider 48 and the seal 44. The passage 53 is controlled by a poppet valve 55, which is responsive to the diaphragm 50. The chamber 54 communicates through an opening in the seal 44 and a passage 57 in the body 10 with the annular chamber 31.

Accordingly, as long as the poppet valve 53 is open, a poppet valve 58, which controls the passage 47, is open, and the opening 39 is not closed due to the liquid within the tank reaching a predetermined level that indicates that the tank is filled, the venturi effect created by the flow of the liquid between the seat ring 26 and the poppet valve 25 draws air through the vacuum tube 38 to create a partial vacuum within the chamber 36. However, as soon as the opening 39 is blocked or the valve 55 or 58 is closed, the chamber 36 has its pressure reduced due to the air therein being drawn therefrom because of the venturi effect in the passages 30 whereby the diaphragm 33 moves upwardly since the partial vacuum in the chamber 36 is increased. This venturi effect is more particularly described in U.S. Pat. No. 3,085,600 to Briede.

The diaphragm 33 has a latch retaining pin 60 secured thereto for movement therewith and disposed between three balls 61 (two shown), which are positioned within passages in a latch plunger 62. When the latch retaining pin 60 is in the position shown in FIG. 1, the balls 61 prevent downward movement of the latch plunger 62, which is slidably mounted within an insert 63. The insert 63, which is preferably formed of a plastic, is supported in the body 10.

When the diaphragm 33 is moved upwardly due to the increase in the partial vacuum in the chamber 36, the latch retaining pin 60 is moved upwardly therewith. The upward movement of the latch retaining pin 60 disposes a tapered portion of the latch retaining pin 60 between the balls 61 whereby the balls 61 may move inwardly to allow the latch plunger 62 to be moved downwardly against the force of its spring 64. The correlation between the tapered portion of the latch retaining pin 60 and the latch plunger 62 is more specifically shown in U.S. Pat. No. 2,582,195 to Duerr.

The lower end of the latch plunger 62 is connected to the handle 22 as more particularly shown and described in U.S. Pat. No. 3,817,285 to Wilder et al. Thus, when the diaphragm 33 moves upwardly to pull the latch retaining pin 60 and release the latch plunger 62 from the balls 61, the force of the spring 20 closes the main poppet valve 19 as more particularly shown and described in the aforesaid Wilder et al patent.

The body 10 has a bellows 65, which is preferably formed of a gasoline resistant synthetic rubber or urethane, for example, secured thereto and extending from the outlet 12 of the body 10 towards the free or discharge end of the spout 14. The bellows 65 is disposed in spaced relation to the spout 14 to form an annular passage 66 therebetween. The outer end of the bellows 65 has a sealing means 67 removably connected thereto in the manner more particularly shown and described in the copending patent application of Jack A. McMath for "Liquid Dispensing Nozzle Having Vapor Recovery Sealing Arrangement," Ser. No. 970,814, filed Dec. 18, 1978 now U.S. Pat. No. 4,235,266, and assigned to the same assignee as the assignee of this application. The sealing means 67 has a large central opening 68 to enable the sealing means 67 to slide along the spout 14.

The spout 14 has a latch ring 69 thereon for engagement with a lip 70 (see FIG. 2) of the fill pipe 16 to hold the free end of the spout 14 within the fill pipe 16. The latch ring 69 is secured to the spout 14 by suitable means such as a set screw, for example.

As more particularly shown and described in the copending patent application of Jack A. McMath for "Liquid Dispensing Nozzle Having A Sealing Arrangement For Vapor Return Means," Ser. No. 856,110, filed Nov. 30, 1977 now abandoned, and assigned to the same assignee as the assignee of this application, a check valve 71 blocks communication of the annular passage 66 with a tank 72 (see FIG. 3). As more particularly shown and described in the aforesaid McMath application, Ser. No. 856,110, the check valve 71 (see FIG. 1) includes a slidable cylindrical member 73, which has a skirt 74 with a cam surface 75 by its end. The cam surface 75 cooperates with an actuator pin 76, which is supported in a bushing 77 in the body 10.

The annular passage 66 communicates with the tank 72 (see FIG. 3) through an annular passage 78 (see FIG. 2), which is formed between the outer surface of the spout 14 and the skirt 74 of the slidable cylindrical member 73. The annular passage 78 communicates with the tank 72 (see FIG. 3) through a longitudinal cut out portion (not shown) in the skirt 74 (see FIG. 2) and a vapor return passage (not shown) in the body 10 as more particularly shown and described in the aforesaid MaMath application, Ser. No. 684,441.

Accordingly, when the spout 14 is disposed in the fill pipe opening 15 so that the sealing means 67 engages the end of the fill pipe 16 to stop movement of the sealing means 67, the continued movement of the spout 14 into the fill pipe opening 15 causes the body 10, which has the spout 14 attached thereto through the spout adapter 17, to move relative to the slidably cylindrical member 73. As a result, the pin 76, which moves with the body 10 because of its disposition within the bushing 77, engages the cam surface 75 of the skirt 74 of the slidable cylindrical member 73. This engagement of the pin 76 with the cam surface 75 cams the pin 76 from the position of FIG. 1 to the position of FIG. 2.

The pin 76 acts through the seal or gasket 44 on one end of the poppet valve 58, which controls the passage 47 in the divider 48 of the housing 45. A spring 79 continuously urges the poppet valve 58 to its closed position of FIG. 1 in which it blocks the passage 47. The spring 79 also urges the pin 76 into the interior of the nozzle body 10 so that the pin 76 cannot be moved out of the bushing 77 except by the cam surface 75.

Thus, when there is relative movement between the slidable cylindrical member 73 and the spout 14 due to the spout 14 being inserted in the fill pipe opening 15 and the sealing means 67 abutting the end of the fill pipe 16 with sufficient force to effectively form a seal around the fill pipe opening 15, the poppet valve 58 is moved to an open position through the pin 76 acting on the end of the poppet valve 58 through the seal or gasket 44. The opening of the poppet valve 58 allows air to flow from the inlet opening 39 in the spout 14 and through the vacuum tube 38, the passage 40 in the spout adapter 17, the annular chamber 41, the passage (not shown) in the body 10, the opening (not shown) in the seal 44, the passage 46 in the housing 45, the passage 47 in the divider 48, the chamber 49, the passage 53 in the divider 48, the chamber 54, the opening in the seal 44, the passage 57 in the body 10, and the annular chamber 31 to the passages 30 in the seat ring 26. This provides a supply of air so that the partial vacuum created in the chamber 36 (see FIG. 1) by the venturi effect is not increased.

Accordingly, the slidable cylindrical member 73 of the check valve 71 allows flow through the body 10 only if the sealing means 67 is in sealing engagement with the end of the fill pipe 16 (see FIG. 2) when the spout 14 is inserted in the fill pipe opening 15 to supply the liquid thereto. If there is not engagement of the sealing means 67 with the end of the fill pipe 16 with sufficient force to form a seal around the fill pipe opening 15, then there will not be the desired relative motion of the spout 14, the spout adapter 17, and the body 10 with respect to the slidable cylindrical member 73. This prevents the poppet valve 58 from being opened so that air is not supplied to the passages 30 in the seat ring 26. This lack of air to the passages 30 in the seat ring 26 causes the partial vacuum in the chamber 36 (see FIG. 1) to increase to close the main poppet valve 19 so that liquid cannot flow through the body 10 and the spout 14.

It should be understood that the main poppet valve 19 must be opened and flow to occur for the partial vacuum to be produced in the chamber 36. However, only a small amount of liquid will flow through the spout 14 before the poppet valve 19 is automatically closed by the increased partial vacuum in the chamber 36. This is because the poppet valve 58 always is closed unless the sealing means 67 (see FIG. 2) is engaging the end of the fill pipe 16 with sufficient force to effectively form a seal around the fill pipe opening 15 and the spout 14 has been inserted into the fill pipe opening 15 a sufficient distance to produce the necessary relative motion to cause the poppet valve 58 to be opened.

Therefore, the poppet valve 58 is closed unless necessary relative motion has occurred. As a result of the poppet valve 58 being closed, opening of the main poppet valve 19 (see FIG. 1) to produce the necessary flow past the passages 30 in the seat ring 26 to produce the partial vacuum in the chamber 36 automatically increases the partial vacuum in the chamber 36 whereby the main poppet valve 19 is automatically closed shortly after being opened.

When the spout 14 is removed from the fill pipe opening 15 (see FIG. 2) so that the sealing means 67 does not engage the end of the fill pipe 16, a return spring 80 produces the relative motion of the spout 14, the spout adapter 17, and the body 10 with respect to the slidable cylindrical member 73. Thus, the slidable cylindrical member 73 moves relative to the actuator pin 76 so that the cam surface 75 on the skirt 74 of the slidable cylindrical member 73 no longer engages the actuator pin 76 whereby the actuator pin 76 can again return into the interior of the body 10 as shown in FIG. 1. When this occurs, the poppet valve 58 is returned to its closed position by the spring 79. Closing of the poppet valve 58 stops air flow through the vacuum tube 38 to the chamber 36 so that the diaphragm 33 is caused to move upwardly to release the latch plunger 62 from the balls 61 whereby the spring 20 closes the main poppet valve 19 to automatically stop flow of liquid through the body 10 if it has not been stopped by the manually operated handle 22.

Figure 2:
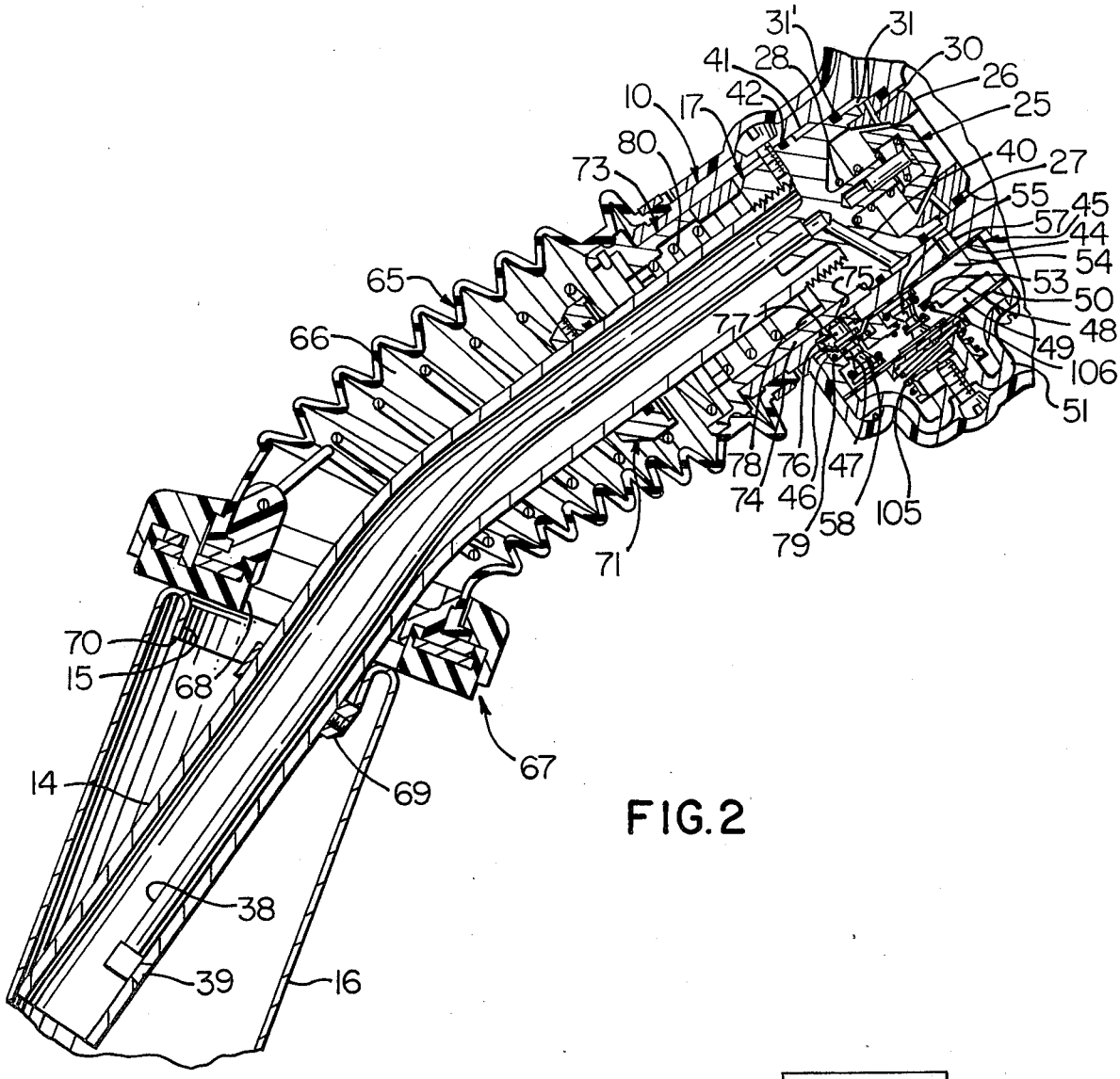
FIG. 2 is a fragmentary sectional view, of a portion of the nozzle of FIG. 1 and showing the spout and fill pipe of a vehicle tank with the seal of the vapor return means being effective.
Figure 3:
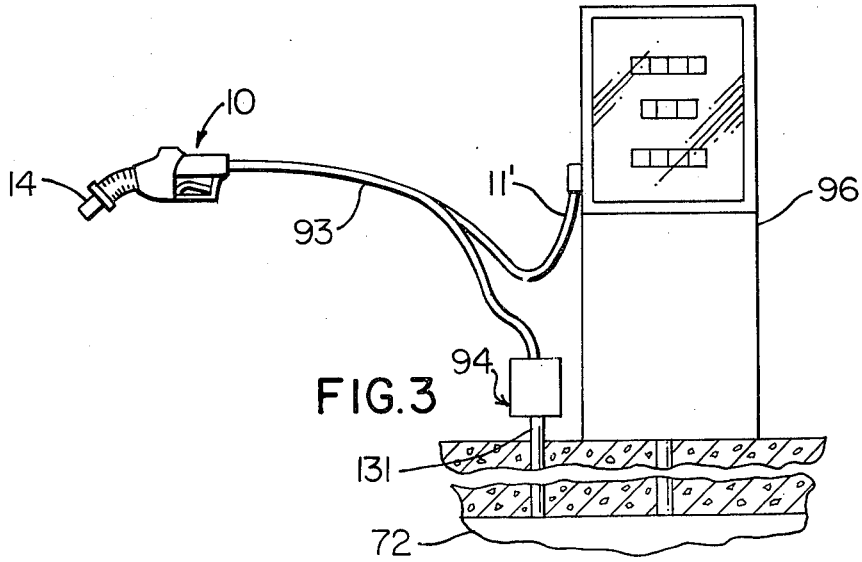
FIG. 3 is a schematic view of the nozzle of FIG. 1 being utilized with the sensing arrangement of the present invention.

Accordingly, when the spout 14 is in the position of FIG. 2, vapor within the tank being filled can flow through the opening 15 in the fill pipe 16 and the opening 68 into the annular passage 66 from which it flows to the tank 72 (see FIG. 3). Thus, the movement of the spout 14 (see FIG. 2) into the fill pipe 16 results in the check valve 71 being opened whereby the vapor can be removed from the tank being filled.

The vapor flows through the vapor return passage (not shown) in the nozzle body 10 to a hose 93 (see FIG. 3), which is a vapor return line. The hose 93 communicates through a body 94 with the tank 72 from which the liquid is initially supplied through a pedestal 96 and the hose 11' to the inlet 11 (see FIG. 1) of the nozzle body 10.

As previously mentioned, the poppet valve 55 is responsive to the diaphragm 50, which has a spring 105 acting thereagainst. A spring 106 has one end disposed in a groove in the poppet valve 55 so that the spring 106 urges the poppet valve 55 to its closed position, but the force of the spring 106 is not as strong as the force of the spring 105, which urges the poppet valve 55 to its normally open position through a rivet in the diaphragm 50 being held against the end of the poppet valve 55 by the spring 105.

However, if the vapor pressure in the tank, which is being filled and has the fill pipe opening 15 (see FIG. 2) sealed by the sealing means 67 engaging the end of the fill pipe 16, increases beyond a predetermined pressure, the diaphragm 50 is moved against the force of the spring 105 to permit the poppet valve 55 to move to its closed position in response to the action of the spring 106. When this occurs, air from the opening 39 in the passages 30 in the seat ring 26 is stopped so that the partial vacuum in the chamber 36 (see FIG. 1) is increased to cause automatic closing of the main poppet valve 19. This response of the diaphragm 50 to the vapor pressure in the sealed tank is more particularly shown and described in the aforesaid Wood patent.

Figure 4:
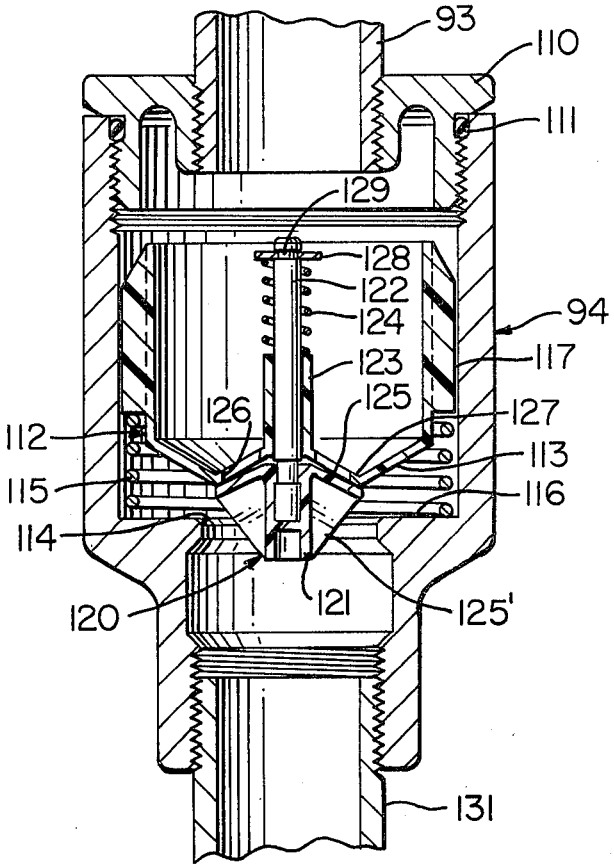
FIG. 4 is a sectional view of one embodiment of the sensing arrangement of the present invention.

As shown in FIG. 4, the body 94 has a plug 110 threadedly connected thereto with an O-ring 111 therebetween. A first poppet valve 112 is disposed within the body 94 and has a seating surface 113 for engaging a seat 114 in the body 94.

Figure 6:
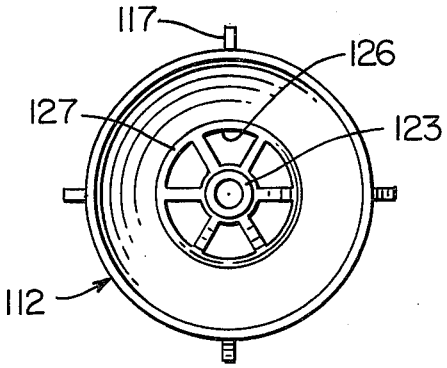
FIG. 6 is a top plan view of a first poppet valve of the sensing arrangement of FIG. 4.

The first poppet valve 112 is urged by a spring 115 to the position of FIG. 1 in which the seating surface 113 does not engage the seat 114. The spring 115 has its lower end acting against a shoulder or flat surface 116 of the body 94 and its upper end engaging the bottom end of each of a plurality of ribs 117 disposed about the outer surface of the first poppet valve 112 and equally angularly spaced from each other as shown in FIG. 6. The ribs 117 not only guide the first poppet valve 112 in its movement within the body 94 (see FIG. 4) but also allow vapor to flow between the first poppet valve 112 and the body 94 when the seating surface 113 of the first poppet valve 112 is not engaging the seat 114.

The first poppet valve 112 supports a second poppet valve 120 at its lower end. The second poppet valve 120 includes a hollow cylindrical body 121, which is formed of a suitable plastic such as acetal, for example, and a stem 122, which is formed of metal, having its lower end disposed in a recess in the body 121. The stem 122 is slidably disposed within a guide 123 of the first poppet valve 112.

The second poppet valve 120 is urged by a spring 124 to the position in which its conical shaped sealing surface 125, which is at the upper end of the body 121 and supported by a plurality of equally angularly spaced ribs 125', blocks equally angularly spaced passages 126 in a surface 127 of the first poppet valve 112. The spring 124 acts between the upper end of the guide 123 of the first poppet valve 112 and a pushnut 128, which is carried in a groove 129 in the stem 122 adjacent its upper end.

Accordingly, when a predetermined quantity of liquid arrives at the first poppet valve 112 in a predetermined period of time, the force of the spring 115 is overcome to move the first poppet valve 112 downwardly until the seating surface 113 of the first poppet valve 112 engages the seat 114 in the body 94. When this occurs, vapor can no longer pass around the exterior of the first poppet valve 112.

Accordingly, the hose 93 is blocked so that vapor cannot flow from the tank being filled. Thus, the pressure in the tank, which is being filled and has the fill pipe opening 15 (see FIG. 2) sealed by the sealing means 67 engaging the end of the fill pipe 16, increases beyond a predetermined pressure so that the poppet valve 55 is moved to its closed position. As a result, the main poppet valve 19 (see FIG. 1) is automatically closed by the increase in the partial vacuum in the chamber 36. Thus, the first poppet valve 112 (see FIG. 4) senses the presence of a predetermined quantity of liquid in a predetermined period of time at a predetermined location and uses this to stop the flow of liquid through the nozzle body 10 (see FIG. 1).

If the pressure in the tank should exceed a predetermined pressure when the seating surface 113 (see FIG. 4) of the first poppet valve 112 is engaging the seat 114, venting can occur through the second poppet valve 120 being moved downwardly against the force of the spring 124. As a result, the vapor and liquid can flow through the passages 126 in the surface 127 of the first poppet valve 112 since the sealing surface 125 of the second poppet valve 120 is no longer in its sealing position.

Figure 5:
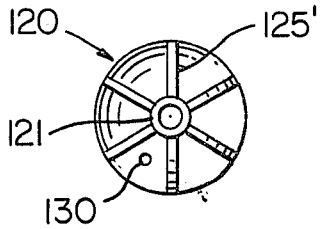
FIG. 5 is a bottom plan view of a second poppet valve of the sensing arrangement of FIG. 4.

The sealing surface 125 of the second poppet valve 120 has a bleed passage 130 (see FIG. 5) extending therethrough. Thus, liquid is drained from the first poppet valve 112 (see FIG. 4) through the bleed hole 130 (see FIG. 5) in the sealing surface 125 of the second poppet valve 120 over a period of time.

The liquid flows from the body 94 (see FIG. 4) through a conduit 131 to the underground storage tank 72 (see FIG. 3). The conduit 131 supports the body 94 above the tank 72.

Figure 7:
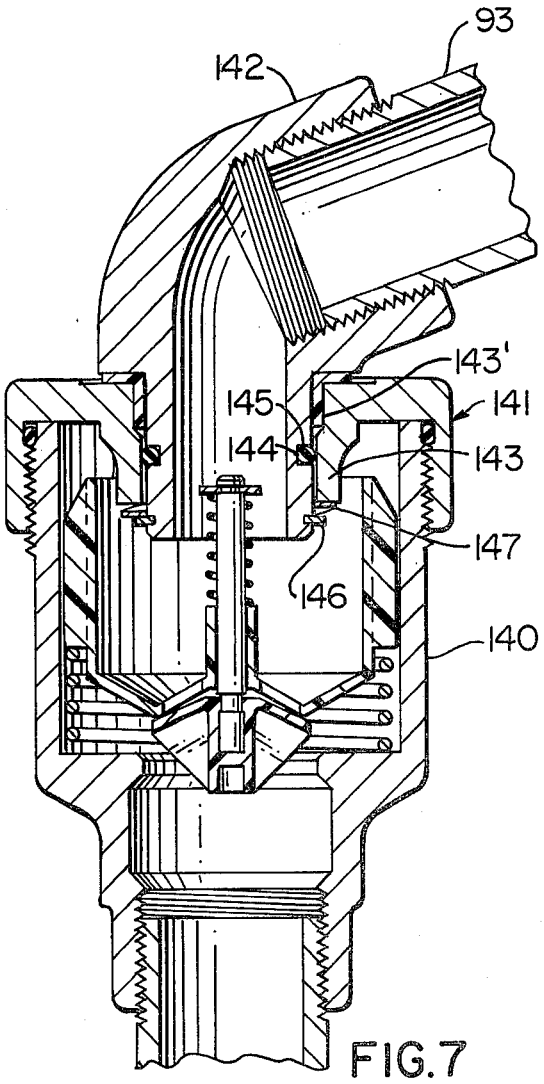
FIG. 7 is a sectional view of another form of the sensing arrangement of the present invention.

Referring to FIG. 7, there is shown another form of the present invention in which the body 94 (see FIG. 4) is replaced by a body 140 so that a cap 141 can be utilized in place of the plug 110 (see FIG. 4). The use of the cap 141 enables a swivel body 142 to be connected thereto whereby a swivel connection is formed between the body 140 and the hose 93.

The swivel body 142 is rotatably mounted within a bearing portion 143 of the cap 141 through a flange bearing 143', which is formed of a suitable plastic such as acetal, for example. A sealing ring 144 is disposed within an annular groove 145 in the swivel body 142 and engages the bearing portion 143 of the cap 141 to form a seal between the cap 141 and the swivel body 142. The swivel body 142 is retained within the cap 141 by a retaining ring 146. A wave spring 147 is disposed between the retaining ring 146 and the end of the bearing portion 143 of the cap 141 to maintain electrical continuity between the cap 141 and the swivel body 142. The remainder of the structure of FIG. 7 is the same as that shown and described for FIG. 4.

Figure 8:
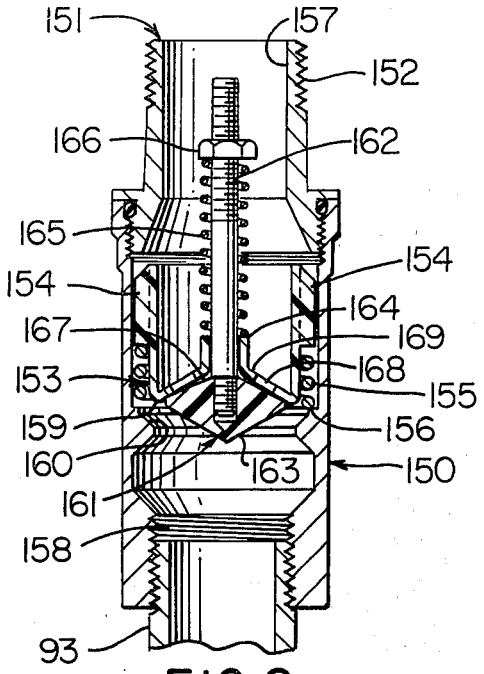
FIG. 8 is a sectional view of a further form of the sensing arrangement of the present invention.

Referring to FIG. 8, there is shown another form of the sensing arrangement of the present invention. A body 150 has a cap 151 with threads 152 thereon for threading the cap 151 into the nozzle body 10 (see FIG. 1) instead of the hose 93. Thus, the body 150 (see FIG. 8) can be disposed at any angle and still function whereas the preferred orientation of the body 94 (see FIG. 4) is vertical. This is because the first poppet valve 112 in the body 94 primarily relies upon the weight of the liquid to cause it to close.

The body 150 has a first poppet valve 153 disposed therein. The first poppet valve 153 has a plurality of ribs 154, preferably four, formed on its outer surface in equally angularly spaced relation to each other. The ribs 154 function as a guide for the first poppet valve 153 and to allow vapor to flow through the body 150 between the outer surface of the first poppet valve 153 and the inner surface of the body 150 when the first poppet valve 153 is in the position of FIG. 8.

A spring 155, which has its lower end engaging a shoulder 156 of the body 150 and its upper end engaging the bottoms of the ribs 154, continuously urges the first poppet valve 153 to the position shown in FIG. 8 wherein vapor can flow from inlet 157 of the cap 151 around the exterior of the first poppet valve 153 to an outlet 158 of the body 150. The hose 93 is connected to the body 150 at the outlet 158 to convey the vapor to the tank 72 (see FIG. 3).

If liquid enters the inlet 157 (see FIG. 8) of the cap 151, its velocity provides sufficient pressure to overcome the force of the spring 155 and move the first poppet valve 153 so that a seat engaging surface 159 of the first poppet valve 153 engages a seat 160 in the body 150. When this occurs, vapor can no longer flow through the body 150. This blocks the vapor return means in the nozzle body 10 (see FIG. 1) so that the pressure in the tank being filled increases. As a result, the poppet valve 55 is moved to its closed position to cause the main poppet valve 19 in the nozzle body 10 to be moved to its closed position to stop liquid flow to the tank being filled.

The first poppet valve 153 (see FIG. 8) has a second poppet valve 161 supported thereby through a stem 162, which is threaded into a body 163 of the second poppet valve 161, extending upwardly through a guide 164 of the first poppet valve 153. A spring 165 acts between the upper surface of the guide 164 and a nut 166, which is threaded on the stem 162 to continuously urge a sealing surface 167 of the second poppet valve 161 to a sealing position in which its seals a plurality of equally angularly spaced openings or passages 168 in a surface 169 of the first poppet valve 153.

Accordingly, the force of the spring 165 is such that the second poppet valve 161 is maintained in a position in which it closes the openings 168 unless the pressure upstream of the second poppet valve 161 increases beyond a predetermined amount. Thus, the second poppet valve 161 will open if the pressure upstream thereof increases beyond the predetermined amount.

Because of the relative sizing of the first poppet valve 153, the velocity of the liquid impinging on the first poppet valve 153 moves it to its closed position. Thus, it does not have to be disposed vertically to respond to the presence of liquid in the vapor return means.

The second poppet valve 161 has a bleed passage (not shown) to allow bleeding of the liquid from the first poppet valve 153 when the second poppet valve 161 is closed. Thus, the use of the body 150 enables the liquid to be drained much quicker than when the body 94 (see FIG. 3) is used because the quantity of the trapped liquid is much smaller. For example, the body 94 is located approximately fourteen feet from the end of the nozzle body 10 with which the hose 93 is connected.

Figure 9:
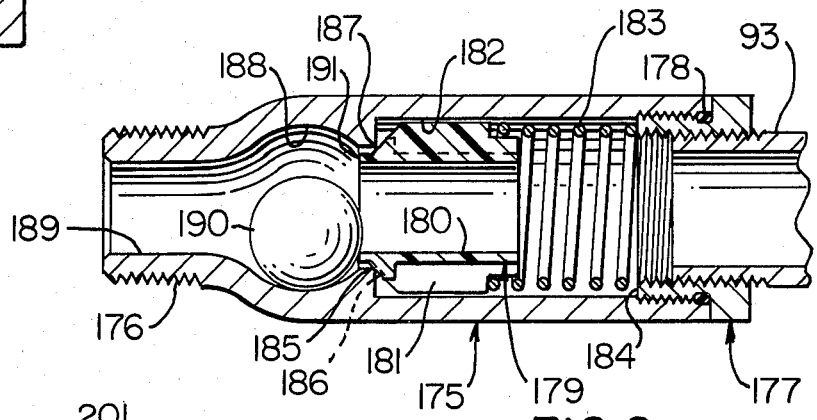
FIG. 9 is a sectional view of another embodiment of the sensing arrangement of the present invention.

Referring to FIG. 9, there is shown another embodiment of the invention including a body 175, which is mounted at the vapor outlet at the end of the nozzle body 10 (see FIG. 3) instead of the hose 93 in the same manner as the body 150 (see FIG. 8). The body 175 (see FIG. 9) has threads 176 for threading into the nozzle body 10.

Thus, the body 175 has its longitudinal axis normally substantially horizontal or at some angle thereto. Therefore, the modification of FIG. 9 is capable of functioning when the longitudinal axis of the body 175 is horizontal or disposed up to thirty degrees from either side of the horizontal.

The body 175 has an adapter 177 threaded at the opposite end from the threads 176 to connect the hose 93. An O-ring 178 is disposed between the adapter 177 and the body 175.

A poppet valve 179, which is formed of a plastic material such as acetal, for example, is disposed within the body 175 and has a longitudinal passage 180 extending therethrough. The poppet valve 179 has a plurality of equally angularly spaced ribs 181, preferably four, disposed on its outer surface to space the poppet valve 179 from inner cylindrical surface 182 of the body 175 and to guide the movement of the poppet valve 179 within the body 175.

Figure 10:
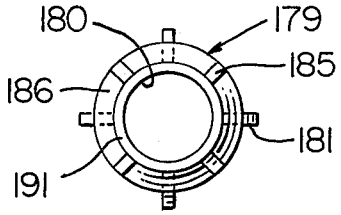
FIG. 10 is an end elevational view of the poppet valve used in the sensing arrangement of FIG. 9.

A spring 183, which has one end acting against an end surface 184 of the adapter 177 and its other end acting against the end of each of the ribs 181 of the poppet valve 179, continuously urges the poppet valve 179 to a position in which equally, angularly spaced ribs 185 (see FIG. 10) on an inclined surface 186 of the poppet valve 179 engage a seat 187 (see FIG. 9) in the body 175. The ribs 185 hold the inclined surface 186 slightly spaced from the seat 187 to provide bleed drainage means for liquid when necessary. It should be understood that the spacing is so slight that very little, if any, vapor can flow between the inclined surface 186 and the seat 187.

The body 175 has an enlarged spherical shaped recess 188 between its inlet 189 and the poppet valve 179. The recess 188 has a hollow ball valve 190, which is formed of a suitable plastic material such as acetal, for example, disposed therein. When liquid enters the inlet 189 of the body 175, it collects in the recess 188 and causes the ball valve 190 to float upwardly and inwardly into the end of the longitudinal passage 180 in the poppet valve 179 to engage a circular seat 191 on the upstream end of the poppet valve 179. This positioning of the ball valve 190 against the seat 191 blocks liquid flow through the body 175 to increase the pressure within the tank, which is being filled. Accordingly, in the same manner as previously described, the poppet valve 55 (see FIG. 1) is moved to its closed position due to the increased pressure within the tank being filled to cause the main poppet valve 19 in the nozzle body 10 to be moved to its closed position to stop liquid flow through the nozzle body 10. When the upstream pressure increases beyond a predetermined amount, the poppet valve 179 opens against spring 183 to allow passage of liquid.

When the valve 190 is in the position of FIG. 9, vapor flows through the passage 180 in the poppet valve 179. Thus, only the presence of liquid in the body 175 prevents the vapor flow and increases the pressure within the tank, which is being filled.

Figure 11:
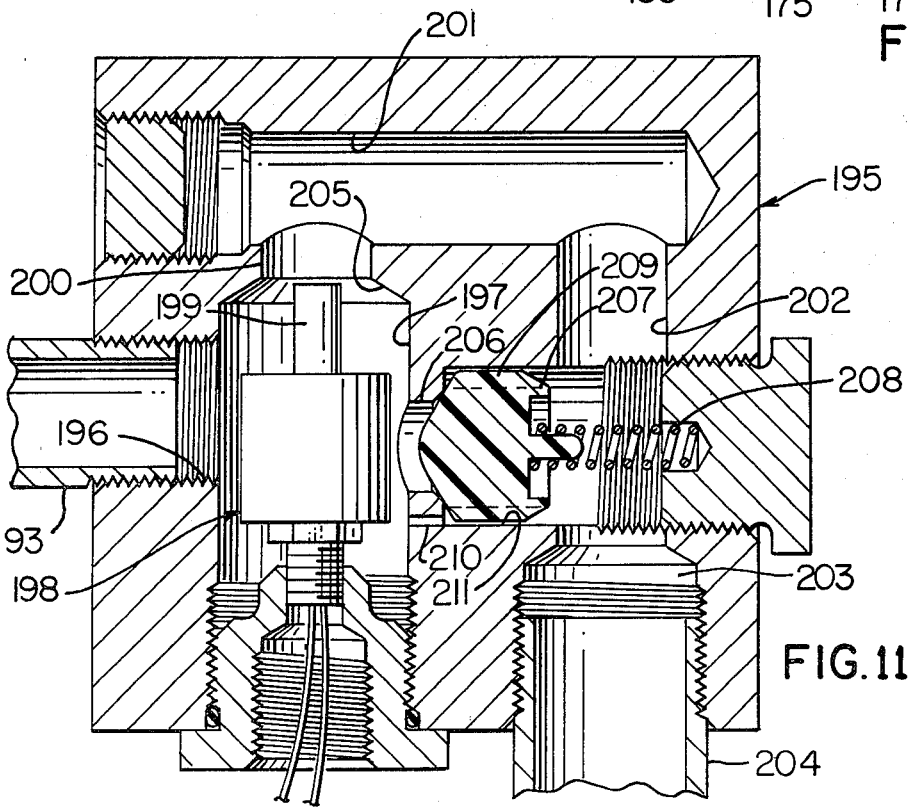
FIG. 11 is a sectional view of a further modification of the sensing arrangement of the present invention.

Referring to FIG. 11, there is shown another embodiment of the present invention in which a body 195 replaces the body 94 in FIG. 3. The body 195 (see FIG. 11) has a passage 196 in which the hose 93 communicates.

The passage 196 in the body 195 communicates with a chamber 197 in the body 195. Thus, vapor flows from the hose 93 through the passage 196 to the chamber 197.

A float switch 198 is disposed within the chamber 197 and mounted for sliding movement along a stem 199. One suitable example of the float switch 198 is a level switch sold by Gems Sensors Division of DeLaval, Farmington, Conn. as part number 42295120, LS-3.

When the float switch 198 is in the position of FIG. 11, vapor can flow from the hose 93 through the passage 196 and the chamber 197 to a passage 200, which is smaller than the chamber 197, in the body 195. Then, the vapor flows through a connecting, lateral passage 201 in the body 195 to a passage 202. The passage 202 communicates with an enlarged chamber 203 in the body 195 and with which a conduit 204, which supports the body 195, communicates. The conduit 204 communicates with the underground tank 72 (see FIG. 3) so that the vapor is returned thereto.

When a predetermined quantity of liquid flows through the vapor hose 93 in a predetermined period of time, the float switch 198 (see FIG. 11) is moved upwardly into engagement with a seat 205 in the body 195 at the junction of the chamber 197 and the passage 200. This prevents both liquid and vapor flow through the hose 93.

When the float switch 198 engages the seat 205, a switch within the stem 199 is activated. This produces a signal, which can be utilized to stop supply of liquid from the pedestal 96 (see FIG. 3), for example. The chamber 197 (see FIG. 11) has a lateral passage 206 communicating therewith. The passage 206, which is not blocked when the float switch 198 engages the seat 205, has its communication with the passage 202 blocked by a poppet valve 207, which is biased to its closed position by a spring 208. Therefore, if the vapor and liquid pressure in the chamber 197 should exceed a predetermined pressure when the float switch 198 is engaging the seat 205, venting can occur through the passage 206 and past the poppet valve 207.

The poppet valve 207 has equally, angularly spaced ribs 209, preferably four, on its outer surface to serve as guides and to enable liquid to flow around the outer surface of the poppet valve 207. Thus, the increase in pressure in the tank, which is being filled and has the fill pipe opening 15 (see FIG. 2) sealed by the sealing means 67 engaging the end of the fill pipe 16, is limited by the resiliently biased poppet valve 207 (see FIG. 11).

A bleed passage 210 communicates from the chamber 197 to a chamber 211 in which the poppet valve 207 is disposed. The bleed passage 210 enables bleeding of the liquid and the vapor in the chamber 197 therefrom through the bleed passage 210 and the chamber 211 to the passage 202.

The body 195 can be employed other than with the nozzle body 10 (see FIG. 1) in which flow of liquid is controlled by the main poppet valve 19. That is, the signal from the movement of the float switch 198 (see FIG. 11) can be utilized with a system in which there is not automatic shut off of liquid flow.

While the present invention has shown and described the sensing arrangements as being utilized with an automatic shut-off nozzle, it should be understood that such is not a requisite for satisfactory operation. Thus, some of the modifications of the sensing arrangements could be employed in any location in which a change in pressure can be utilized to stop liquid flow producing a vapor.

An advantage of this invention is that it allows vapor flow through a vapor line without impediment but can stop flow when liquid enters the vapor line. Another advantage of this invention is that it prevents recirculation of liquid. A further advantage of this invention is that it avoids fraud on a customer at a gasoline service station by the operator.

Figure 12:
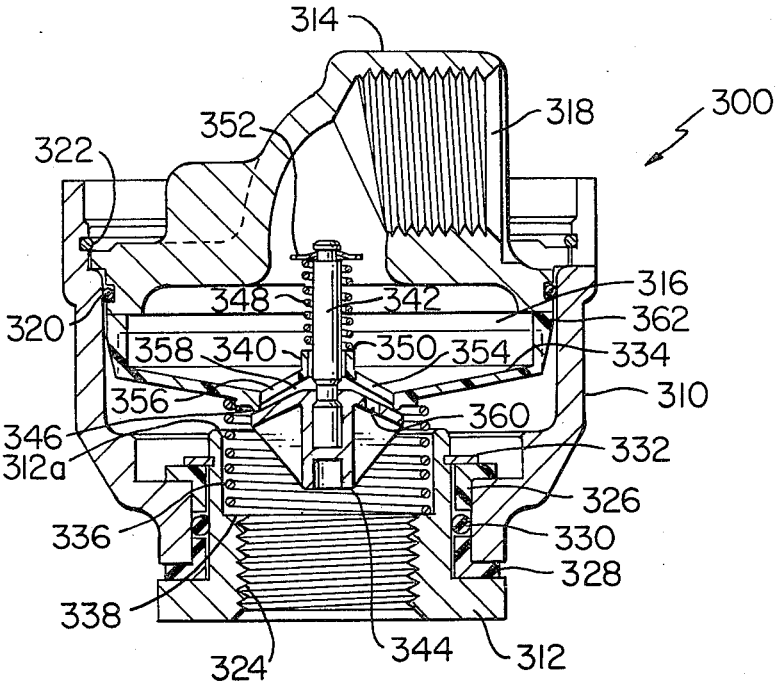
FIG. 12 is a sectional view of a further embodiment of a component of the present invention.
Figure 16:
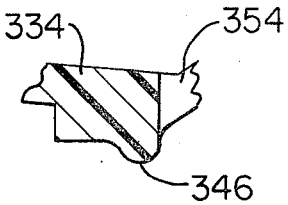
FIG. 16 is a fragmentary cross sectional enlargement of a spacing member upon the first poppet valve of FIG. 15.

FIG. 12 depicts a still further embodiment of an apparatus which may be substituted for the body 94 illustrated in FIG. 4. In this embodiment, a body 300 is comprised of a base portion 310 and a tail portion 312, the tail portion 312 being rotatably fitted and attached to the base portion 310 so as to form a swivel between the two portions. A cap 314 is fitted into an outlet 316 of the body 300 and contains a through flow passage 318 which is in fluid communication with the nozzle body 10 (FIG. 1) by way of the hose 93 (FIG. 3). An O-ring 320 assists in sealing the periphery of the cap 314 to the base portion 310 of the body 300 and a round wire form retainer 322 holds the cap and body together.

As mentioned above, the tail portion 312 of body 300 is rotatably connected to the base portion 310 and this connection is located proximal to an outlet 324 of the body 300. A pair of bushings 326 and 328, preferably formed of a plastic material such as acetal, are interposed between the base 310 and tail 312 portions to assist in the relative movement between these body portions. An electrically conductive elastomeric O-ring 330 is interposed between the paired bushings 326 and 328 in contacting relationship with both the base and tail portions to provide an electrical conductivity therebetween to eliminate the possibility of static electricity build-up between the body portions. A retainer ring 332 is fitted into an annular groove on an external surface of the tail portion 312 which extends into the interior of the base portion 310. The retainer ring 332 extends over and rests upon the uppermost of the paired bushings 326.

Like the previously described embodiments, the embodiment of FIG. 12 has first and second valve means. The first valve means 334 of FIG. 12 embodiment is a poppet valve with a cup shaped configuration and is positioned for generally vertical reciprocal movement within the base portion 310. This movement ranges from the first position depicted in FIG. 12 to a second position in which it is seated against the upper portion of tail portion 312, which upper portion forms a seat 312*a*. It is thus seen that the tail 312 is multi-purpose and that it functions both as a seat and as a swivel component.

A biasing means, specifically illustrated as a compression spring 336 urges the first poppet valve 334 to the first position illustrated in FIG. 12. The spring 336 rests upon an interior annular ridge 338 formed in the tail portion 312 and is compressed between that ridge 338 and the underside of the first poppet valve 334.

Figure 13:
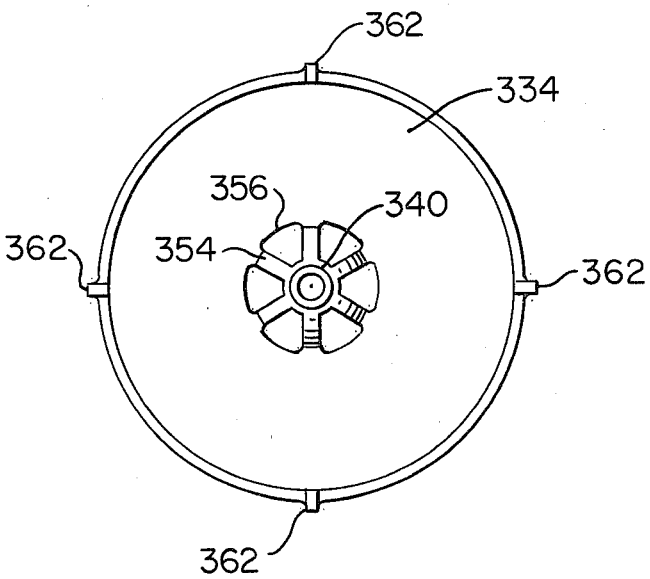
FIG. 13 is a plan view of a first poppet valve used in the embodiment of FIG. 12.
Figure 15:
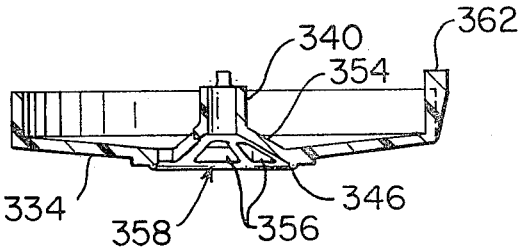
FIG. 15 is a sectional view of the first poppet valve of FIGS. 13 and 14.

As shown in FIGS. 12, 13, and 15, the first poppet valve 334 has a centrally disposed stem receptive guideway 340, which guideway 340 serves as a pilot for a stem 342 of a second valve means 344. In the preferred embodiment, the second valve means takes the form of a poppet valve, preferably formed of a plastic material such as acetal with the stem 342 being preferably formed of aluminum. The second poppet valve is urged to a first closed position (as illustrated in FIG. 12) against a raised seat 346 by a compression spring 348. The seat 346 extends from and is part of the first valve means 334. The spring 348 extends between a ridge 350 on the stem guideway 340 and a retainer in the form of a push nut 352, which push nut 352 engages an annular groove in the valve stem 342.

The stem receptive guideway 340 is essentially cylindrical in shape and is supported upon the remainder of the first poppet valve by a plurality of annularly spaced ribs 354. In the illustrated embodiment, six ribs 354 are shown and these ribs 354 define an equal number of apertures or passages 356 interposed between the supporting ribs 354. As shown most clearly in FIGS. 12 and 15, the ribs 354 extend radially inward toward the guideway 340 and upwardly to define a space 358 beneath the stem guideway 340, ribs 354 and passages 356, which space 358 is vertically disposed with respect to the seat 346 for the second poppet valve 344.

The second poppet valve 344 also has a relatively small bleed passage 360 extending therethrough. This bleed passage 360 insures that, irrespective of the positions of the first and second valves 334 and 344 respectively, at least some communication between the valve inlet 318 and outlet 324 will exist. The bleed passage 360 permits the draining of any liquid which has accumulated in the first poppet valve 334 over a period of time. The space 358 insures that this fluid communication will not be impared by the relative angular position of the second poppet valve 344 with respect to the first 334, i.e., irrespective of whether passage 360 through the second poppet valve 334 is positioned directly beneath one of the ribs 354.

Figure 14:
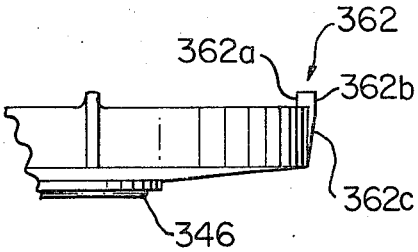
FIG. 14 is a fragmentary elevational view of the first poppet valve of FIG. 13.

The first poppet valve 334 has a plurality of angularly spaced longitudinal ribs 362 on its periphery which serve to guide the first poppet valve 334 during its vertical or reciprocal movement within the base portion 310 of body 300. The configuration of the ribs 362 is depicted most clearly in FIG. 14 which shows that the ribs have a vertical extension 362*a* with a cylindrically shaped contact surface 362*b* for sliding contact with the cylindrically shaped intersurface of base portion 310. The contact surface 362*b* terminates proximal to the top of the first poppet valve member's periphery (exclusive of the extensions). Adjacent to the contact portion 362*b* is an angularly shaped wedge section 362*c* with a maximum radial extension adjacent to the contact surface 362*b* and a minimum radial extension at the bottom of the first poppet valve's periphery. The wedge shaped portion 362*c* of the rib has a constant slope from the maximum radial extension to the minimum radial extension. This configuration of ribs 362, in effect, removes the bottom corner from the ribs and greatly reduces the possibility that the first poppet valve will "stick" in the body due to any slight misalignment of the valve.

When engaged with the base portion 310 of body 300, the radially extending ribs 362 provide spaces or passages between the ribs. These passages permit vapor flow to pass around the first poppet valve 334 from one side of the valve to the other when the valve is in the first illustrated position. The vertical extensions 362*a* of the longitudinally extending ribs provide a predetermined spacing between the uppermost portion of the first poppet valve in the bottom of cap 314 when the first valve 334 is urged to the first position illustrated in FIG. 12. This insures that vapor flow between the inlet 316 and the passages between the ribs 362 is provided at all times.

As those skilled in the art will readily appreciate from the foregoing, the operation of the FIG. 12 embodiment is similar to the operation of the previously described embodiments. In the absence of liquid in the line, vapor will normally enter body 300 through the flow passage 318 in cap 314. The vapor will then principally flow about the periphery of the first poppet valve 334 through the peripheral spaces between the first poppet valve 334 and the base portion 310, which peripheral spaces are provided by the ribs 362. Although a very small percentage of the vapor flow will pass through bleed passage 360 when the first and second poppet valves 334 and 344 are in the positions illustrated in FIG. 12, most of the vapor flow is through the peripheral spaces between the first poppet valve 334 and the base portion 310. This is because the second poppet valve 344 is seated against the first poppet valve 334 due to the biasing influence of compression spring 348. Consequently, passages 356 are closed (exclusive of the bleed passage 360).

As should be apparent from the depiction of FIG. 12 and the foregoing description, any liquid flowing through body 300 from hose 93 (see FIG. 3) will be collected in the cup shaped configuration of the first poppet valve 334. If a predetermined quantity of liquid arrives in the first poppet valve 334 within a predetermined period (generally at a rate in excess of that which can pass through bleed passage 360), the weight of the accumulating liquid overcomes the bias of compression spring 336 to force the first poppet valve 334 vertically downwardly to a seated position against seat 312*a*. When so seated, the first poppet valve 334 blocks the upper flow passage about its periphery (at the interface of the poppet valve 334 and seat 312*a*). This blocks vapor flow through the hose and increases the pressure in the tank being filled. When the tank pressure increases beyond a predetermined level, poppet valve 55 in the nozzle is moved to its closed position which, in turn, results in automatic closing of the nozzle's main poppet valve 19 (see FIG. 1). Thus, in a manner analogous to the previously described embodiments, the first poppet valve 334 serves to sense the presence of a predetermined quantity of liquid in a predetermined period of time and operates to stop fluid flow through the nozzle in response to this parameter.

If the pressure in the tank being filled should become excessive and exceed a predetermined pressure when the first poppet valve 334 is seated, venting can occur through the passages 356. The opening of passages 356 occurs because the excessive pressure moves the second poppet valve 344 to an open position against the bias of compression spring 348.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An arrangement for sensing the presence of liquid in a vapor line including a body having an inlet communicating with a source of liquid and vapor and an outlet communicating with an area for receiving vapor, said body having passage means therein connecting said inlet and said outlet, said body having first and second valves disposed in said passage means, said body having a seat for one of said first and second valves, said one valve of said first and second valves having a seat for the other of said first and second valves, means to continuously urge one of said one and other valves into engagement with its seat, and the other of said one and other valves being movable into engagement with its seat when a predetermined quantity of liquid flows into said inlet of said body in a predetermined period of time to block said passage means whereby the presence of liquid is sensed, and the one valve of said one and other valves being moved out of engagement with its seat if the pressure upstream of said inlet exceeds a predetermined pressure after the other valve of said one and other valves has engaged its seat.

2. The arrangement according to claim 1 in which the other valve of said one and other valves has its seat in said body and the other valve of said one and other valves had the seat for the one valve of said one and other valves.

3. The arrangement according to claim 2 including means to continuously urge the other valve of said one and other valves away from its seat.

4. The arrangement according to claim 1 in which the one valve of said one and other valves has its seat in said body and the one valve of said one and other valves has the seat for the other valve of said one and other valves.

5. An automatic shut-off nozzle comprising a body having an inlet and an outlet, valve means in said body controlling flow of liquid from said inlet to said outlet, means controlling the operation of said valve means, a spout communicating with said outlet and having its free end for disposition in an opening of a fill pipe of a tank or the like, means to return vapor from the tank being filled, sealing means to form a seal between the fill pipe opening and said vapor return means when said spout is disposed in the fill pipe, said vapor return means including a body having its inlet communicating with the tank being filled and its outlet communicating with an area for receiving vapor, said vapor return means body having passage means therein connecting said inlet of said vapor return means body and said outlet of said vapor return means body, said vapor return means body having first and second valves disposed in said passage means, said vapor return means body having a seat for one of said first and second valves, said one valve of said first and second valves having a seat for the other of said first and second valves, means to urge one of said one and other valves into engagement with its seat, the other of said one and other valves being movable into engagement with its seat when a predetermined quantity of liquid flows into said inlet of said vapor return means body in a predetermined period of time to block said passage means whereby said controlling means is activated to move said valve means to its closed position to stop liquid flow through said nozzle body, and the one valve of said one and other valves being moved out of engagement with its seat if the pressure upstream of said inlet exceeds a predetermined pressure after the other valve of said one and other valves has engaged its seat.

6. The nozzle according to claim 5 in which the other valve of said one and other valves has its seat in said body and the other valve of said one and other valves has the seat for the one valve of said one and other valves.

7. The nozzle according to claim 6 including means to urge the other valve of said one and other valves away from its seat.

8. The nozzle according to claim 5 in which the one valve of said one and other valves has its seat in said body and the one valve of said one and other valves has the seat for the other valve of said one and other valves.

9. The nozzle according to claim 5 in which said controlling means includes manual operated means controlling the operation of said valve means, release means to release said manual operated means to allow closing of said valve means to stop liquid flow through the nozzle body, a chamber, said flexible means forming a wall of said chamber and having said release means connected thereto; communicating means communicates said chamber with the tank being filled; means creates a partial vacuum in said chamber when liquid is flowing through said nozzle body; means blocks said communicating means when the pressure in the sealed tank being filled exceeds a predetermined pressure; and the other of said one and other valves blocking said vapor return means when the predetermined quantity of liquid flows at the predetermined location in the predetermined period of time to cause an increase in the pressure in the sealed tank beyond the predetermined pressure to cause said blocking means to block said communicating means to increase the partial vacuum in said chamber to move said release means to release said manual operated means to close said valve means.

10. An apparatus for sensing the presence of liquid in a vapor line, comprising:

(a) a body having an inlet and an outlet and a flow passage therebetween, said inlet being adapted to communicate with a source of liquid and vapor and said outlet being adapted to communicate with an area for receiving the vapor;

(b) first valve means disposed in said body for selectively blocking said flow passage, said first valve means being movable between a first open position in which vapor flow past said first valve is permitted to a second position in response to liquid flow in said body, said first valve means being operative to block vapor flow between the inlet and outlet in the second position, said first valve being biased to the first position; and (c) second valve means for selectively permitting fluid flow past said first valve means, said second valve means being movable between a first seated position against said first valve to a second open position, said second valve means being biased to said first position and movable to said second position in response to a predetermined liquid pressure.

11. An apparatus as recited in claim 10 wherein said body includes a base and a tail member, said tail member being rotatably fitted to said base member.

12. An apparatus as recited in claim 11 wherein said tail member serves as a seat for said first valve means.

13. An apparatus as recited in claim 12 wherein said tail member and said base member are connected by an elastomeric sealing member which serves as an electrical path between said tail and said base members.

14. An apparatus as recited in claim 13 further including a passage means through said first valve means, said second valve means being operative to block said passage in its first seated position.

15. An apparatus as recited in claim 14 further including means for spacing said second valve means from said first valve means when said second valve means is in its first seated position.

16. An apparatus as recited in claim 15 wherein said second valve means has a bleed passage therethrough providing limited fluid communication between said inlet and outlet irrespective of the positions of the first and second valve means.

17. An apparatus as recited in claim 15 wherein said first valve means has a plurality of longitudinal ribs which extend radially outward along its periphery, which ribs are in sliding relationship to the interior of said body as said first valve means is moved between its first and second positions, said ribs having a maximum radial extension proximal to the top portion of the periphery and a minimum radial extension at the bottom portion of the periphery.

18. An apparatus as recited in claim 17 wherein said ribs extend longitudinally upward from said first valve means to limit upward movement of said first valve means and to space said first valve means from the inlet.

19. An apparatus as recited in claim 18 wherein said ribs have a body engagement portion of constant diameter proximal to the top of the first valve means and an adjacent portion whose diameter constantly decreases as it extends downwardly.

20. An apparatus as recited in claim 10 further including a passage means through said first valve means, said second valve means being operative to block said passage in its first seated position.

21. An apparatus as recited in claim 20 further including means for spacing said secod valve means from said first valve means when said second valve means is in its first seated position.

22. An apparatus as recited in claim 21 wherein said second valve mean has a bleed passage therethrough providing limited fluid communication between said inlet and outlet irrespective of the positions of the first and second valve means.

23. An apparatus as recited in claim 10 wherein said first valve means has a plurality of longitudinal ribs which extend radially outward along its periphery, which ribs are in sliding relationship to the interior of said body as said first valve means is moved between its first and second positions, said ribs having a maximum radial extension proximal to the top portion of the periphery and a minimum radial extension at the bottom portion of the periphery.

24. An apparatus as recited in claim 23 wherein said ribs extend longitudinally upward from said first valve means to limit upward movement of said first valve means and to space said first valve means from the inlet.

25. An apparatus as recited in claim 24 wherein said ribs have a body engagement portion of constant diameter proximal to the top of the first valve means and an adjacent portion whose diameter constantly decreases as it extends downwardly.

* * * * *